United States Patent [19]

Zangrando

[11] Patent Number: 4,647,089

[45] Date of Patent: Mar. 3, 1987

[54] DEAD BOLT LOCK OPERABLE BY PRESSURIZED FLUID

[75] Inventor: Roy A. Zangrando, Boonton, N.J.

[73] Assignee: The United States of America as represented by the Secretary of the Army, Washington, D.C.

[21] Appl. No.: 623,254

[22] Filed: Jun. 21, 1984

[51] Int. Cl.[4] ..... E05C 1/08

[52] U.S. Cl. ..... 292/144; 70/275; 70/DIG. 48; 292/252; 403/322; 403/325

[58] Field of Search ..... 292/144, 252, 147, 150; 70/DIG. 48, 275; 403/325, 328, 322

[56] References Cited

U.S. PATENT DOCUMENTS

| | | | |
|---|---|---|---|
| 1,054,126 | 2/1913 | Lindberg | 403/322 X |
| 1,635,144 | 7/1927 | Stevens | 403/328 X |
| 1,935,715 | 11/1933 | Hunt et al. | 292/252 |
| 3,617,081 | 11/1971 | Drucker | 292/252 |
| 3,753,316 | 8/1973 | Savarieau et al. | 292/144 X |
| 4,082,342 | 4/1978 | Ailshie et al. | 292/144 X |
| 4,127,966 | 12/1978 | Schmidt | 292/252 X |
| 4,512,597 | 4/1985 | Nabb et al. | 292/252 X |

FOREIGN PATENT DOCUMENTS

| | | | |
|---|---|---|---|
| 0591631 | 2/1978 | U.S.S.R. | 403/322 |
| 0748048 | 7/1980 | U.S.S.R. | 403/322 |

*Primary Examiner*—Robert L. Wolfe
*Assistant Examiner*—Lloyd A. Gall
*Attorney, Agent, or Firm*—Anthony T. Lane; Robert P. Gibson; Michael C. Sachs

[57] ABSTRACT

A bolt of a dead bolt lock is moveable between a locking position and an unlocking position by application of a pressurized fluid. In both the locking and unlocking positions a plurality of locking balls are urged into locking engagement with a locking groove and are maintained in such locking engagement by a resiliently urged locking cam without the necessity for maintaining the pressurized fluid once the required condition is attained. Application of the pressurized fluid unlocks the bolt, displaces it to its alternate position and locks it in place.

4 Claims, 6 Drawing Figures

DEAD BOLT LOCK OPERABLE BY PRESSURIZED FLUID

The invention described herein may be manufactured, used and licensed by or for the Government for Governmental purposes without the payment to me of any royalties thereon.

BACKGROUND OF THE INVENTION

The present invention relates to locking devices and, more particularly, to locking devices of the dead bolt type which are actuated between the locked and the unlocked positions by application of a pressurized fluid.

Some applications require locking devices which are secure, tamper-proof and are unlikely to generate potentially dangerous signals or effects. Although the present invention should not be considered limited to a particular application, one application in which the above requirements are in effect is in igloos of the type in which ammunition and weapon systems may be stored. Such igloos typically are earth covered and include a door having as secure a locking device as possible.

It is customary to employ substantial padlocks on igloo doors to impede unauthorized entry. A need for ease of entry for authorized personnel limits the impediments which can be placed in the way of unauthorized entry. Electrically operated locking devices are attractive alternatives to padlocks in some applications because of the sophisticated coding which electrical, and especially electronic, locking devices permit. The use of electrical devices in the vicinity of sensitive explosives, such as may be contained in the above igloos, is not favored for safety reasons.

OBJECTS AND SUMMARY OF THE INVENTION

Accordingly, it is an object of the invention to provide a locking device which overcomes the drawbacks of the prior art.

It is a further object of the invention to provide a locking device which provides a substantial deterrent to unauthorized operation but which is relatively easily actuated by authorized personnel.

It is a still further object of the invention to provide a locking device which provides remote operation without the use of electrical devices.

It is a still further object of the invention to provide a locking device which can be placed in a secure locked condition and in a secure unlocked condition by the application of a pressurized fluid. Once placed in the open or locked position, the locking device is effective to maintain the selected position against unintended stimuli such as, for example, gravity or tampering, without the need for additional application of pressurized fluid.

It is a still further object of the invention to provide a rugged, reliable and low cost locking device.

Briefly stated, the present invention provides a dead bolt locking device having a bolt which is moveable between a locking position and an unlocking position by application of a pressurized fluid. In both the locking and unlocking positions, a plurality of locking balls are urged into locking engagement with a locking groove and are maintained in such locking engagement by a resiliently urged locking cam without the necessity for maintaining the pressurized fluid once the required condition is attained. Application of the pressurized fluid unlocks the bolt, displaces it to its alternate position and locks it in place.

According to an embodiment of the invention, there is provided a dead bolt lock comprising a barrel, a bolt slidable within the barrel between a locking position and an unlocking position, actuating means responsive to application of a pressurized fluid for selectively displacing the bolt between the locking and the unlocking positions, at least one locking groove in a surface of the barrel adjacent the bolt, a cavity in the bolt, at least one radial hole from the cavity to a surface of the bolt adjacent a surface of the barrel, a locking ball in the at least one radial hole, the at least one radial hole being aligned with the at least one locking groove in at least one of the locking and the unlocking positions, cam means for urging the locking ball into engagement with the locking groove whereby the bolt is locked in one of its locking and unlocking positions and resilient means for maintaining the cam means in a position maintaining the engagement without requiring additional application of the pressurized fluid.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
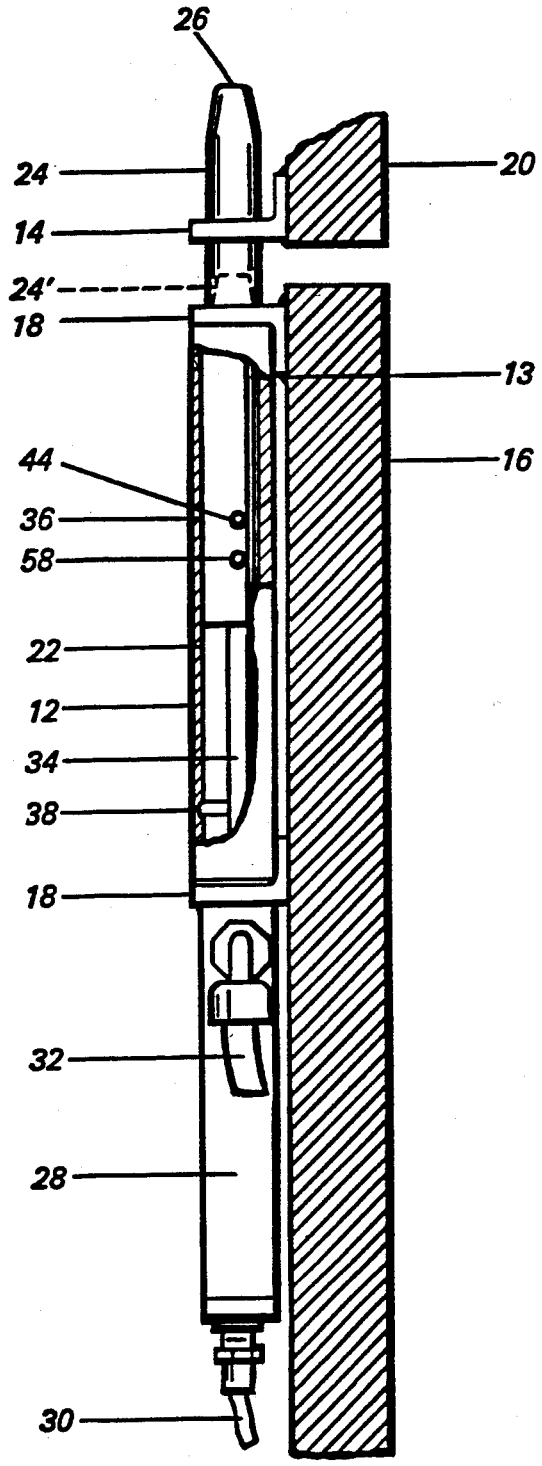
FIG. 1 is a side view, in partial cross section, of a dead bolt lock according to an embodiment of the invention.

Referring to FIG. 1, there is shown, generally at 10, a dead bolt lock according to an embodiment of the invention. Dead bolt lock 10 includes an actuating part 12, which may be installed either on a door frame or on a door, and a passive part 14 which may be installed on the other of the door frame and the door. For purposes of illustration, and not as a limitation, actuating part 12 is shown installed on a door 16 with brackets 18 using conventional means such as, for example, screws or bolts (not shown) or welds 13. Passive part 14 is shown installed on a door frame 20 using, for example, conventional screws or bolts (not shown) or welds 13. Dead bolt lock 10 may, of course, be installed on the inside of door 16 and door frame 20. It would be clear to one skilled in the art that, dead bolt lock 10 may be buried within the door system being locked rather than surface mounted as in the illustrated embodiment.

Actuating part 12 includes a cylindrical barrel 22 within which a cylindrical bolt 24 may be actuated between its extended locking position shown in full line and its retracted unlocking position shown in dashed line 24'. It will be evident from an examination of FIG. 1 that, when bolt 24 is in its extended locking position, an end 26 of bolt 24 passes through, and engages, passive part 14 to effect locking of door 16 to door frame 20. When bolt 24 is retracted to its dotted-line position 24', end 26 is withdrawn clear of passive part 14, thus permitting door 16 to be opened.

Bolt 24 is displaced between its locking and unlocking positions by a pressurized fluid piston 28 which receives pressurized fluid such as, for example, pressurized air, on a locking fluid line 30 and an unlocking fluid line 32. An actuating rod 34 transmits actuating forces from pressurized fluid piston 28 to bolt 24 as will be more fully detailed hereinafter. An annular locking groove 36 is disposed in the inner surface of cylindrical barrel 22 at an end thereof more distant from pressurized fluid piston 28. An annular unlocking groove 38 is disposed in the inner surface of cylindrical barrel 22 at an end thereof closer to pressurized fluid piston 28. As will be further detailed hereinafter, when pressurized fluid is applied to pressurized fluid piston 28 through locking fluid line 30, bolt 24 is urged into the locking position shown in full line and is positively locked in that position against tampering. Similarly, when pressurized fluid is applied to pressurized fluid piston 28 through unlocking fluid line 32, bolt 24 is urged into its unlocking position 24' shown in dashed line, and is positively locked in that position.

Figure 2:
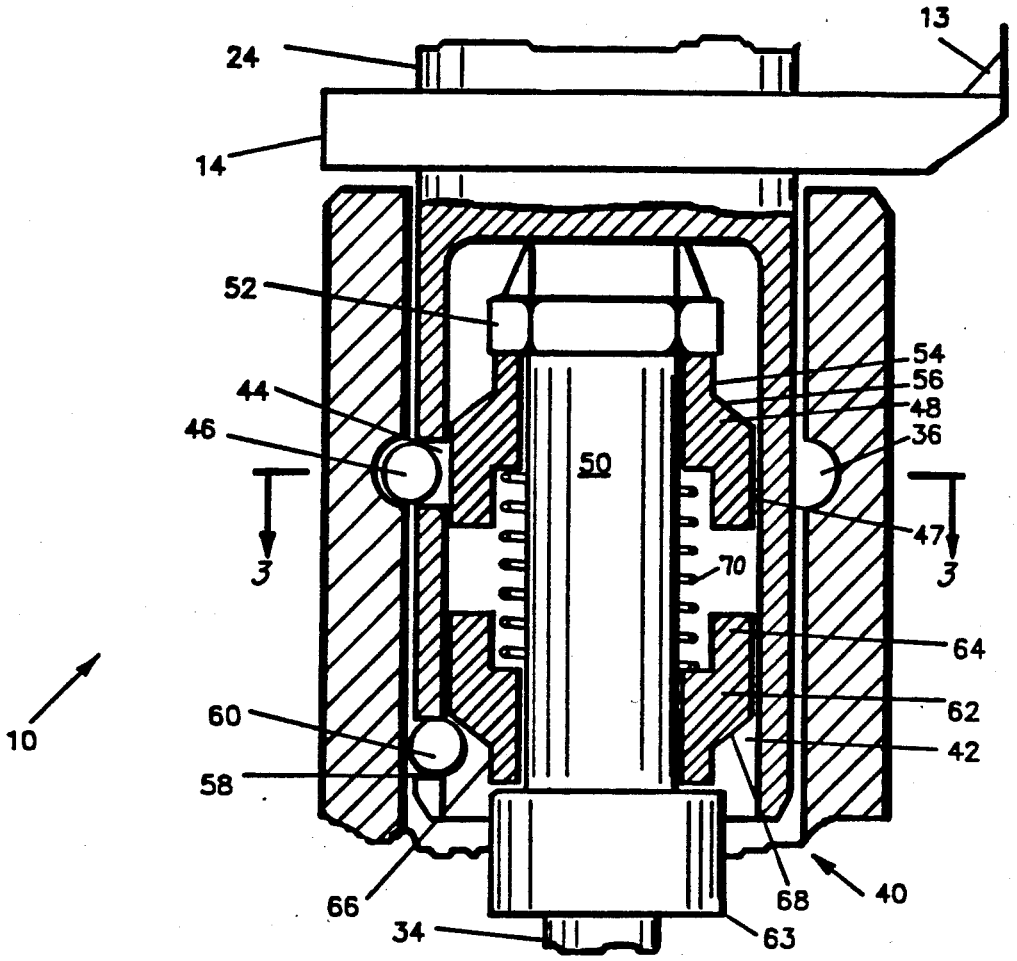
FIG. 2 is an enlarged axial cross section of the dead bolt lock of FIG. 1 in its locked locking position.

Referring now to FIG. 2, bolt 24 is shown locked in its locking position by a double-acting ball-lock assembly 40. An interior of bolt 24 includes a blind cylindrical cavity 42. A first plurality of radial holes 44 communicate radially between blind cylindrical cavity 42 and the exterior of bolt 24. A locking ball 46 is disposed in each radial hole 44. It should be noted that the diameter of locking ball 46 is substantially greater than the wall thickness of bolt 24. In the locking position shown, locking ball 46 is held in annular locking groove 36 by a large diameter portion 47 of a locking lock cam 48 which is slideably disposed on a rod 50. A cap 52 is rigidly affixed at an extremity of rod 50. A small diameter portion 54 is joined to large diameter portion 47 by a ramp portion 56.

A second plurality of radial holes 58 each contains a locking ball 60. An unlocking lock cam 62 is slideably disposed on rod 50. A collar 63 retains unlocking lock cam 62 on rod 50. Unlocking lock cam 62 includes a large diameter portion 64 joined to a smaller diameter portion 66 by a ramp portion 68. A coil spring 70 on rod 50 biases locking lock cam 48 and unlocking lock cam 62 apart. Collar 63 is rigidly affixed to actuating rod 34.

Figure 3:
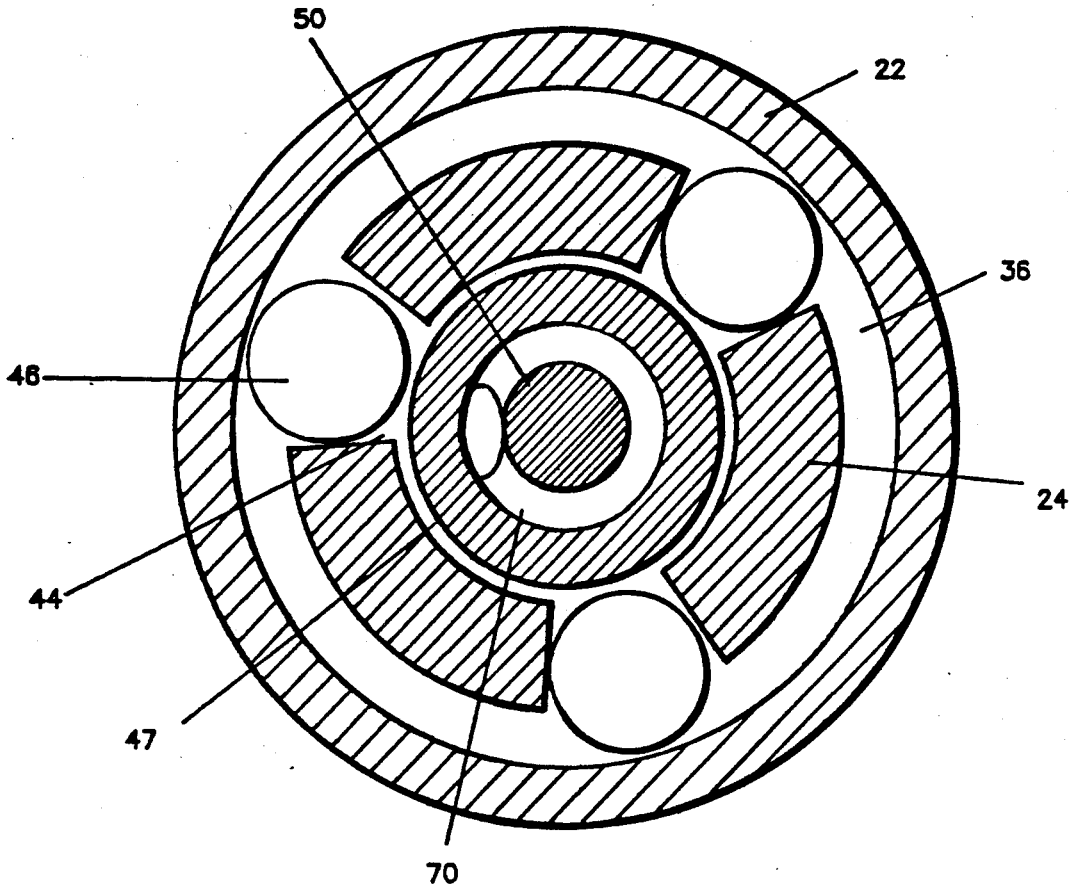
FIG. 3 is a transverse cross section taken along III—III of FIG. 2.

Referring now momentarily to FIG. 3, there are shown three radial holes 44 angularly spaced about bolt 24 each containing a locking ball 46 maintained in an outward locking position with annular locking groove 36 by large diameter portion 47.

Returning now to FIG. 2, when actuating rod 34 is moved downward to unlock dead bolt lock 10, cap 52 urges locking lock cam 48 downward against the resistance of coil spring 70 until small diameter portion 54 is moved adjacent locking ball 46. Locking ball 46 is thereby enabled to move inward to thereby disengage from annular locking groove 36. This permits bolt 24 to be pulled downward by continued downward movement of actuating rod 34.

Figure 4:
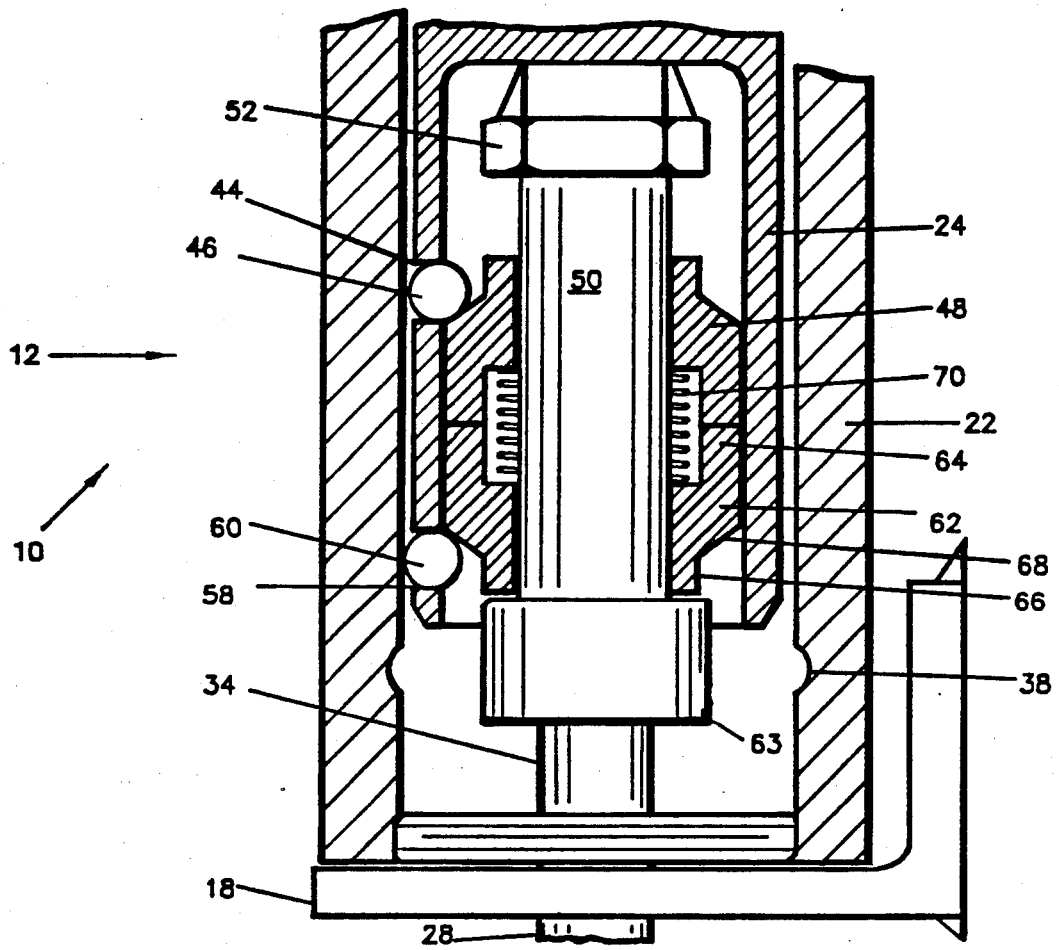
FIG. 4 is an enlarged axial cross section of a dead lock bolt of FIG. 1 in its transition condition between a locking and an unlocking position.
Figure 5:
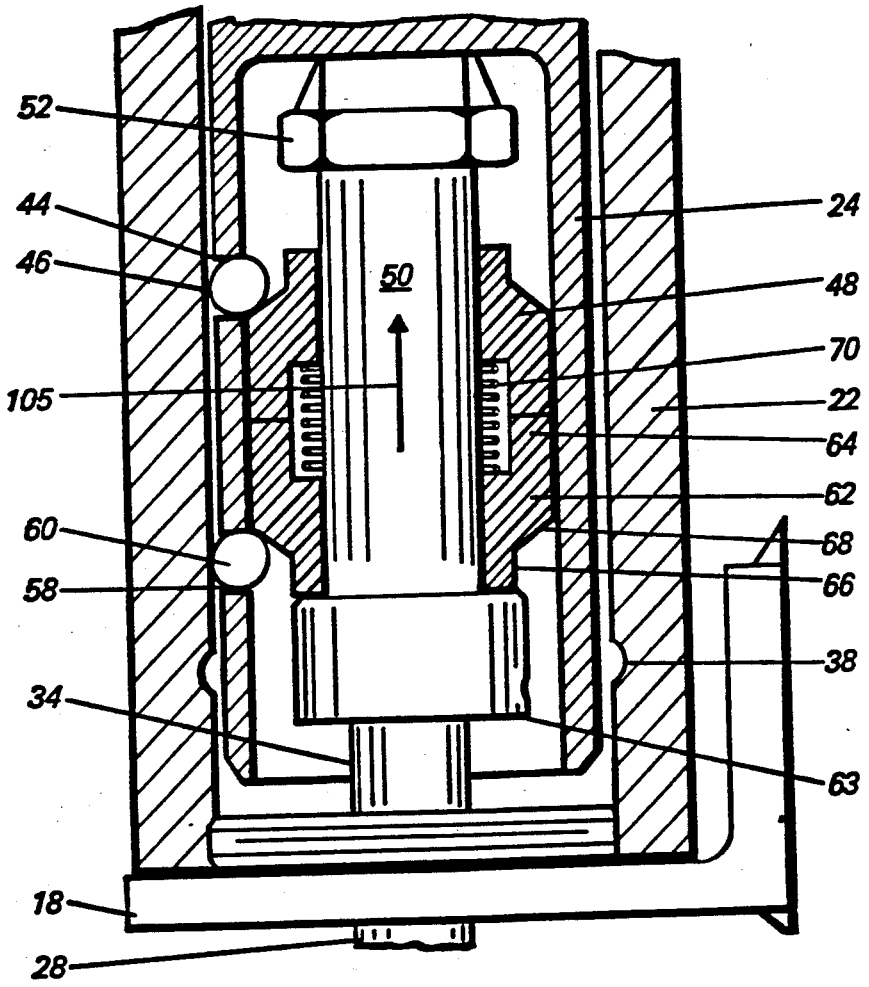
FIG. 5 shows cross-section of the dead bolt lock to illustrate movement of the shaft in the locking direction.
Figure 6:
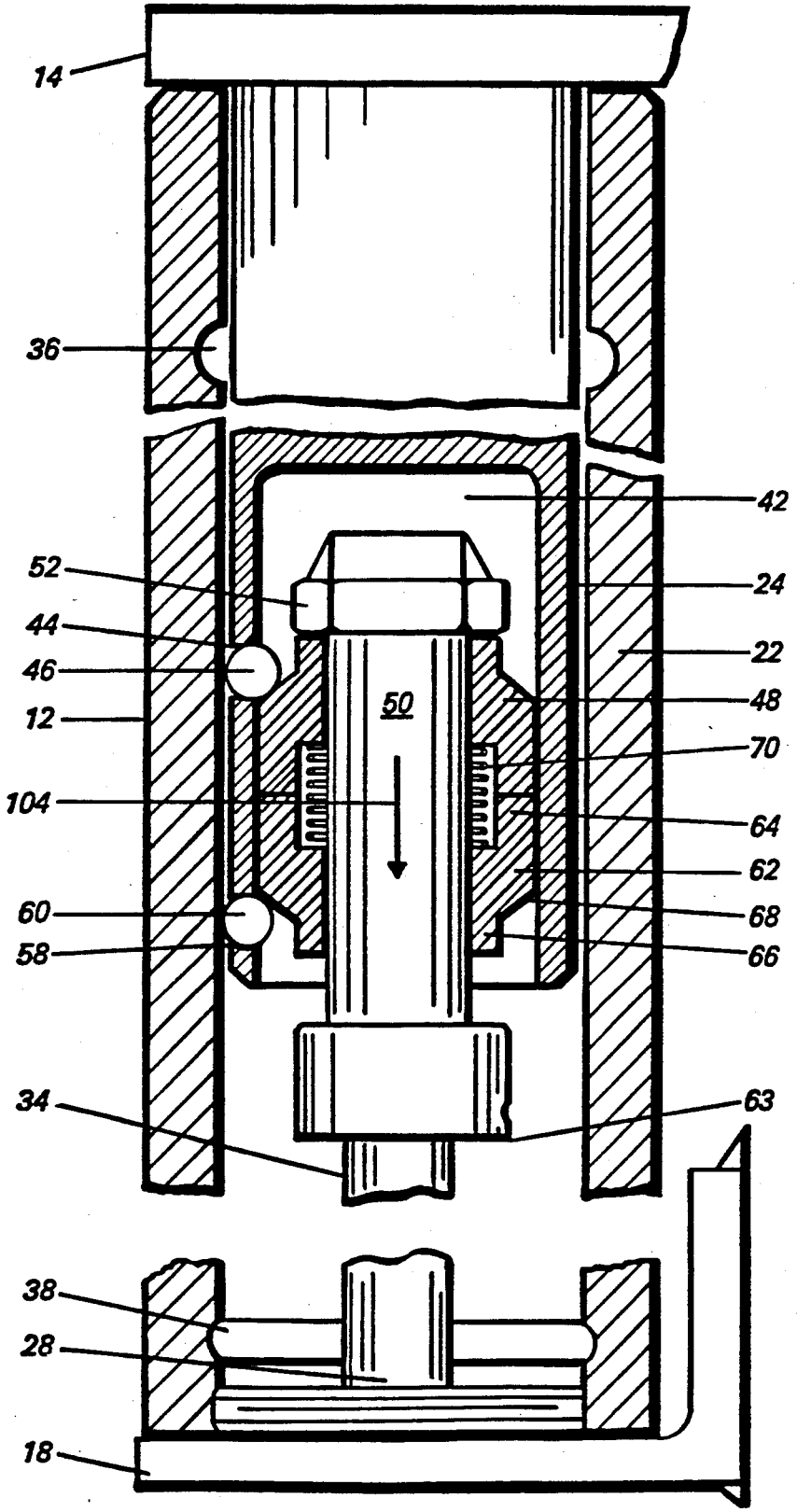
FIG. 6 shows dead bolt lock according to FIG. 4, but in an intermediate position when moving in an unlocking direction.

Referring now to FIG. 4, an intermediate stage of movement is shown in which locking lock cam 48 and unlocking lock cam 62 are captured together by locking ball 46 and locking ball 60 with coil spring 70 maintained in its compressed condition. In this intermediate stage, bolt 24 can be moved downward until locking ball 60 aligns with annular unlocking groove 38 or may be moved upward into the locking position shown in FIGS. 1–3. This is best seen in FIG. 6 which clearly outlines these movements. In this previous case, after actuating rod 34 is moved downward sufficiently to permit it, locking ball 60 is urged outward into annular unlocking groove 38 by ramp portion 68. This permits unlocking lock cam 62 to be displaced downward under the urging of coil spring 70 until large diameter portion 64 moves adjacent to locking ball 60 and thus locks bolt 24 in the unlocked position. FIG. 5 shows how, when moving in lock direction, relative position of shaft 50 changes. Cap 52 abuts the bottom of cylindrical cavity 42 in bolt 24, as shown in FIG. 5 (note arrow).

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A dead bolt lock comprising:

a barrel;

a bolt slidable within said barrel between a locking position and an unlocking position;

actuating means responsive to application of a pressurized fluid for selectively displacing said bolt between said locking and said unlocking positions;

at least one locking groove in a surface of said barrel adjacent said bolt;

a cavity in said bolt;

at least one radial hole from said cavity to a surface of said bolt adjacent a surface of said barrel;

a locking ball in said at least one radial hole;

said at least one radial hole being aligned with said at least one locking groove in at least one of said locking and said unlocking positions;

cam means for urging said locking ball into engagement with said locking groove whereby said bolt is locked in one of its locking and unlocking positions, said cam means including a rod displaceable within said cavity by said actuating means and at least one lock cam slideably disposed on said rod, said at least one lock cam including a small diameter portion, a large diameter portion and a ramp portion joining said large and small diameter portions, said actuating means including means for disposing said small diameter portion adjacent said locking ball during said displacing and for disposing said large diameter portion adjacent said locking ball in one of said locking and unlocking positions, said large diameter portion being effective to maintain said locking ball in said locking groove; and resilient means for maintaining said cam means in a position maintaining said engagement without requiring additional application of said pressurized fluid.

2. A dead bolt lock according to claim 1 wherein said at least one cam lock includes a locking cam lock and an unlocking cam lock on said rod, said at least one radial hole includes at least first and second radial holes axially spaced a predetermined distance apart along an axis of said bolt, a first locking ball in said first radial hole and a second locking ball in said second radial hole, said locking cam lock including a first small diameter portion, a first large diameter portion and a first ramp portion joining said first large and first small diameter portions, said unlocking cam lock including a second small diameter portion, a second large diameter portion and a second ramp portion joining said second large and second small diameter portions, said resilient means being effective for applying a biasing force between said locking cam lock and said unlocking cam lock, said biasing force being effective, when one of said first and second locking balls is aligned with said locking groove, to urge one of said first and second ramp portions against one of said first and second locking balls and to thereby urge said one of said first and second locking balls into locking engagement with said locking groove.

3. A dead bolt lock according to claim 2 wherein said biasing force is further effective for urging one of said first and second large diameter portions into abutment with said one of said first and second locking balls whereby one of a locked locking condition and a locked unlocking condition is maintained without requiring additional application of pressurized fluid.

4. A dead bolt lock comprising:

a generally cylindrical barrel;

a generally cylindrical bolt slideable within said barrel between a locking and an unlocking position;

a generally cylindrical cavity within said bolt;

first and second locking grooves axially spaced a first predetermined distance apart in an inner surface of said cylindrical barrel adjacent said bolt;

first and second radial holes between said cavity and a surface of said bolt adjacent said cylindrical barrel, said first and second radial holes being axially spaced a second predetermined distance apart;

a first locking ball in said first radial hole;

a second locking ball in said second radial hole;

a rod in said cavity displaceable by pressurized fluid means between a locking and an unlocking position;

a locking lock cam on said rod;

an unlocking lock cam on said rod;

resilient means effective for biasing said locking lock cam and said unlocking lock cam apart on said rod;

said locking lock cam and said unlocking lock cam each having a large diameter portion adjacent each other, a small diameter portion at opposed ends thereof and a ramp portion joining said large and small diameter portions;

said large diameter portion being effective, when aligned with its respective locking ball, to hold its respective locking ball engaged in a locking groove and to prevent relative motion between said barrel and said bolt;

said small diameter portion being effective, when aligned with its respective locking ball, to permit said respective locking ball to move radially out of engagement with a locking groove and to thereby permit displacement of said bolt to its alternate position;

means on said rod for selectively disposing a desired one of said large and small diameter portions of a selectable one of said locking lock cam and said unlocking lock cam adjacent its respective locking ball whereby locking and unlocking of said bolt in its locking and unlocking positions is performed; and said means on said rod further including means for displacing said bolt between its locking and unlocking positions.

* * * * *